US008870586B2

(12) United States Patent
Wang et al.

(10) Patent No.: US 8,870,586 B2
(45) Date of Patent: Oct. 28, 2014

(54) RECEPTACLE CONNECTOR, PLUG CONNECTOR AND CONNECTOR ASSEMBLY THEREOF WITH IMPROVED LOCKING STRUCTURE

(75) Inventors: Tao Wang, KunShan (CN); Lin Wu, KunShan (CN); Wei-Ya Cheng, KunShan (CN)

(73) Assignee: Lanto Electronic Limited, Kunshan (CN)

( * ) Notice: Subject to any disclaimer, the term of this patent is extended or adjusted under 35 U.S.C. 154(b) by 184 days.

(21) Appl. No.: 13/455,034

(22) Filed: Apr. 24, 2012

(65) Prior Publication Data

US 2013/0052851 A1 Feb. 28, 2013

(30) Foreign Application Priority Data

Aug. 31, 2011 (CN) ..... 2011 1 0255068

(51) Int. Cl.
*H01R 13/627* (2006.01)
*H01R 13/633* (2006.01)

(52) U.S. Cl.
CPC ..... *H01R 13/6275* (2013.01); *H01R 13/6335* (2013.01)
USPC ..... 439/358

(58) Field of Classification Search
USPC ..... 439/345, 354, 357, 358, 76.1
See application file for complete search history.

(56) References Cited

U.S. PATENT DOCUMENTS 6,416,364 B1 * 7/2002 Shi et al. ..... 439/680
7,175,444 B2 2/2007 Lang et al.
7,601,010 B1 * 10/2009 Wu ..... 439/76.1
7,780,466 B1 * 8/2010 Wu ..... 439/354

* cited by examiner

*Primary Examiner* — Neil Abrams
*Assistant Examiner* — Travis Chambers
(74) *Attorney, Agent, or Firm* — Ladas & Parry, LLP

(57) ABSTRACT

The present invention provides a connector assembly including mateable receptacle connector and plug connector. The plug connector includes a plug insulative housing, a number of plug contacts and a resilient locking member mounted to the plug insulative housing. The locking member includes a front section positioned on the plug insulative housing and a pressing section extending backwardly and upwardly from the front section. The front section includes a first locking protrusion having an inclined first guiding surface and a first locking surface. When the plug connector is inserted in the receptacle connector, the first locking protrusion is downwardly movable under the drive of the pressing section so as to lock with the receptacle connector.

14 Claims, 10 Drawing Sheets

RECEPTACLE CONNECTOR, PLUG CONNECTOR AND CONNECTOR ASSEMBLY THEREOF WITH IMPROVED LOCKING STRUCTURE

CROSS-REFERENCE TO RELATED APPLICATIONS

This application claims to priority to Chinese Application No. 201110255068.0 filed on Aug. 31, 2011 the disclosure of which is incorporated herein by reference in its entirety.

BACKGROUND OF THE INVENTION

1. Field of the Invention

The present invention relates to a receptacle connector, a plug connector and a connector assembly thereof, and more particularly to a receptacle connector, a plug connector and a connector assembly thereof with improved locking structure.

2. Description of Related Art

U.S. Pat. No. 7,175,444 issued to Lang et al. on Feb. 13, 2007, discloses a connector assembly including a plug connector and a receptacle connector. The receptacle connector includes a receptacle housing, a plurality of receptacle contacts fixed to the receptacle housing and a metal shield covering a front side of the receptacle housing. The metal shield includes a top wall, a pair of side walls bent downwardly from lateral edges of the top wall, and a receiving cavity formed between the side walls for accommodating the plug connector. The top wall defines a plurality of slots or depressions. The plug connector includes a plug housing and a locking arm mounted on the plug housing. The locking arm includes a base and an overlap portion above the base. The overlap portion includes a front section, a pressing section extending backwardly and upwardly from the front section, and a tail section at the distal end of the pressing section. The front section is stamped upwardly to form a pair of vertical protrusions and the vertical protrusions can be downwardly moveable under the drive of the pressing section.

When the plug connector is inserted into the receptacle connector, the pressing section needs to be pressed so as to let the vertical protrusions pass through a front surface of the metal shield of the receptacle connector. Once the vertical protrusions reach the slots or the depressions, the pressing section is released, under this condition, due to its restoring force, the vertical protrusions of the pressing section returns upwardly so as to lock with the slots or the depressions.

However, with the vertical protrusions extending along the vertical direction, in order to favorably insert the plug connector into the receptacle connector, it is needed to press the pressing section firstly. In other words, without such pressing force, the vertical protrusions may be stopped by the front surface of the metal shield as a result that the plug connector can not be inserted in the receptacle connector at all.

Because the vertical protrusions of the conventional connector assembly lack of any guiding structure, it is ineffective in using. Hence, it is desirable to provide a receptacle connector, a plug connector and a connector assembly thereof with improved locking structure.

BRIEF SUMMARY OF THE INVENTION

The present invention provides a receptacle connector including a receptacle insulative housing and a plurality of receptacle contacts fixed to the receptacle insulative housing. The receptacle insulative housing includes a mating face, a receiving cavity extending through the mating face for accommodating a mateable plug connector, and a plurality of peripheral walls enclosing the receiving cavity. Each receptacle contact includes a cantilevered contacting portion extending into the receiving cavity. The receptacle insulative housing integrally forms a protrusion which extends beyond one of the peripheral walls. The protrusion defines a receiving chamber in communication with the receiving cavity and a restricting wall for limiting the receiving chamber. The restricting wall includes a first locking face for locking with the plug connector.

The present invention provides a plug connector including an over-molding portion, a plug insulative housing enclosed by the over-molding portion, a plurality of plug contacts fixed in the plug insulative housing and a metallic locking member mounted to the plug insulative housing. The plug insulative housing includes a mating portion protruding forwardly beyond the over-molding portion. The mating portion defines an inserting face. The metallic locking member includes a front section secured to the mating portion and a pressing section extending backwardly and upwardly from the front section. The front section includes a first locking protrusion which is downwardly movable under the drive of the pressing section. The first locking protrusion includes an inclined first guiding surface for easy insertion and a first locking surface behind the first guiding surface for locking with a receptacle connector.

The present invention provides a connector assembly including a receptacle connector and a plug connector mateable with the receptacle connector. The receptacle connector includes a receptacle insulative housing and a plurality of receptacle contacts fixed to the receptacle insulative housing. The receptacle insulative housing includes a mating face, a receiving cavity extending through the mating face for accommodating the plug connector, and a plurality of peripheral walls enclosing the receiving cavity. Each receptacle contact includes a contacting portion extending into the receiving cavity. The receptacle insulative housing integrally forms a protrusion which extends beyond one of the peripheral walls. The protrusion defines a receiving chamber in communication with the receiving cavity and a restricting wall for limiting the receiving chamber. The restricting wall includes a first locking face. The plug connector includes a plug insulative housing, a plurality of plug contacts fixed in the plug insulative housing for engaging with the contacting portions of the receptacle contacts, and a resilient locking member mounted to the plug insulative housing. The plug insulative housing includes a mating portion for being received in the receiving cavity and the mating portion defines an inserting face. The locking member includes a front section secured to the mating portion and a pressing section extending backwardly and upwardly from the front section. The front section includes a first locking protrusion which comprises an inclined first guiding surface and a first locking surface behind the first guiding surface. When the plug connector is inserted in the receiving cavity of the receptacle connector, the first locking protrusion is downwardly movable under the drive of the pressing section so as to make the first locking surface lock with the first locking face.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
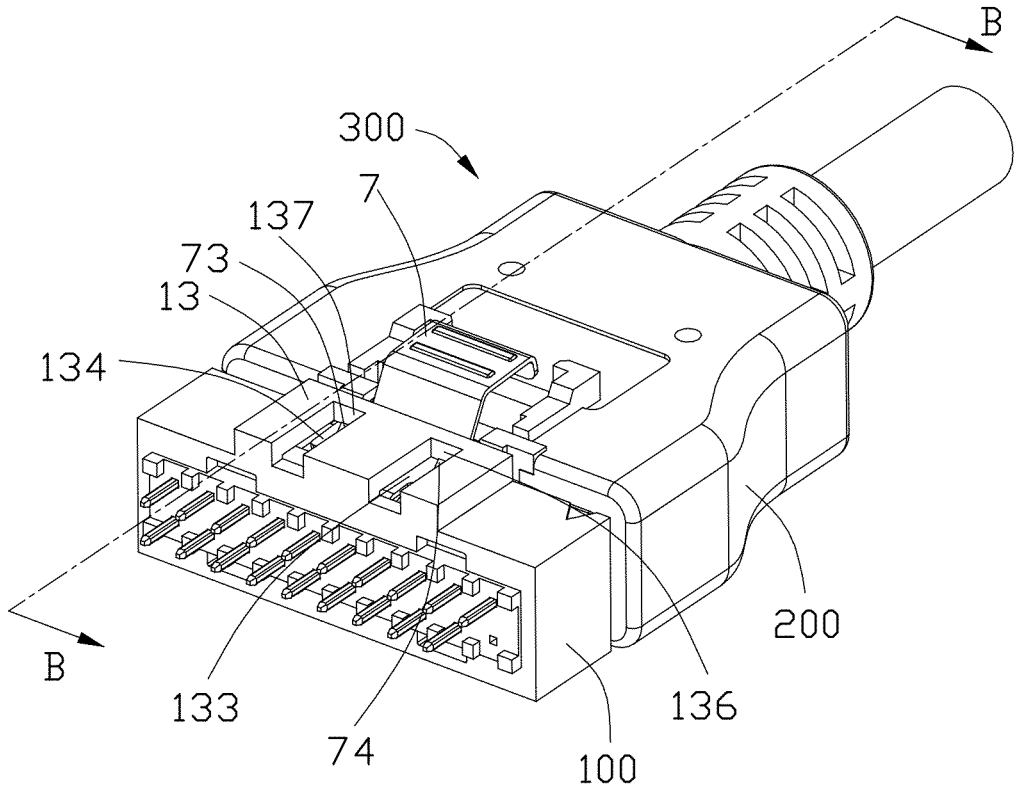
FIG. 1 is a perspective view of a connector assembly in accordance with an illustrated embodiment of the present invention with a plug connector inserted in a receptacle connector.
Figure 2:
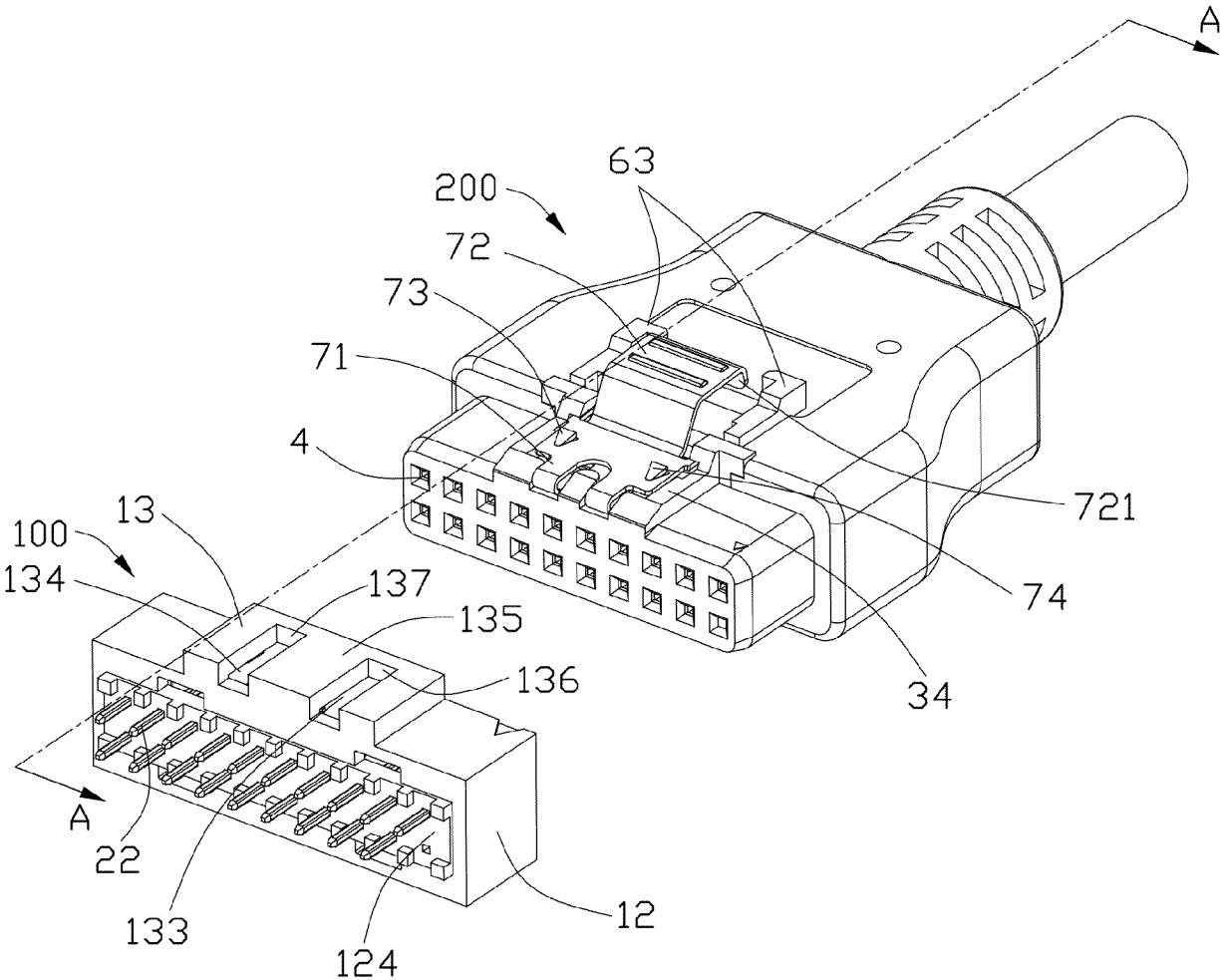
FIG. 2 is an exploded view of the connector assembly as shown in FIG. 1 with the plug connector separated from the receptacle connector.
Figure 3:
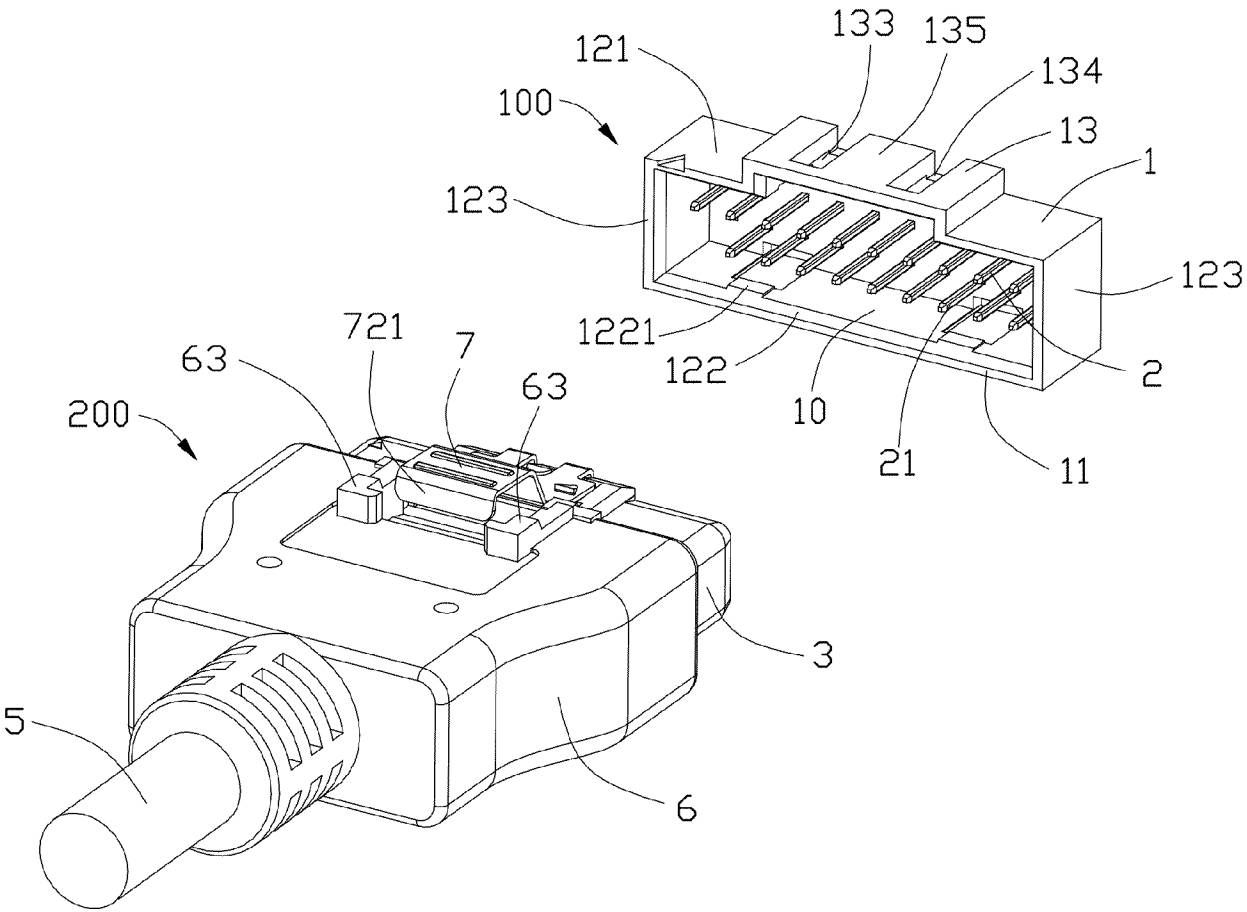
FIG. 3 is another exploded view of the connector assembly as shown in FIG. 2.

Reference will now be made to the drawing figures to describe the preferred embodiment of the present invention in detail. Referring to FIGS. 1 to 3, the illustrated embodiment of the present invention discloses a connector assembly 300 having a receptacle connector 100 and a plug connector 200 for mating with the receptacle connector 100. The receptacle connector 100 includes a receptacle insulative housing 1 and a plurality of receptacle contacts 2 fixed to the receptacle insulative housing 1. The plug connector 200 includes a plug insulative housing 3, a plurality of plug contacts 4 fixed in the plug insulative housing 3 for engaging with the receptacle contacts 2, a cable 5 connected to the plug contacts 4, an over-molding portion 6 enclosing the plug insulative housing 3, and a locking member 7 assembled to the plug insulative housing 3 for locking with the receptacle insulative housing 1.

Referring to FIGS. 2 to 5, the receptacle insulative housing 1 includes a mating face 11, a rectangular receiving cavity 10 extending through the mating face 11 for accommodating the plug connector 200, a plurality of peripheral walls 12 forming and enclosing the receiving cavity 10, and a reversed U-shaped protrusion 13 extending beyond one of the peripheral walls 12. According to the illustrated embodiment of the present invention, the plurality of peripheral walls 12 include a top wall 121, a bottom wall 122 and a pair of side walls 123 connecting the top wall 121 and the bottom wall 122. According to the illustrated embodiment of the present invention, the protrusion 13 is integral with the receptacle insulative housing 1 and extends upwardly beyond the top wall 121 for reducing assembly costs. The top wall 121 and the bottom wall 122 respectively include a pair of embosses 1211, 1221 exposed to the receiving cavity 10 so that, on one hand, when the plug connector 200 is received in the receiving cavity 10 of the receptacle connector 100, engaging friction therebetween can be improved by the embosses 1211, 1221, and on the other hand, the embosses 1211, 1221 are capable of preventing unmateable plug connectors from being inserted in the receptacle connector 100.

Figure 4:
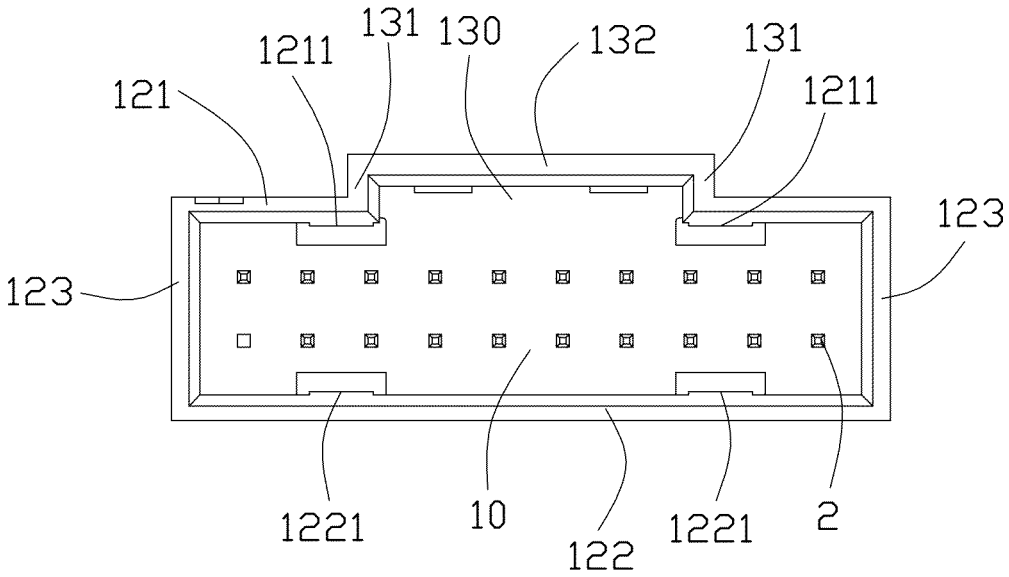
FIG. 4 is a front view of the receptacle connector.
Figure 5:
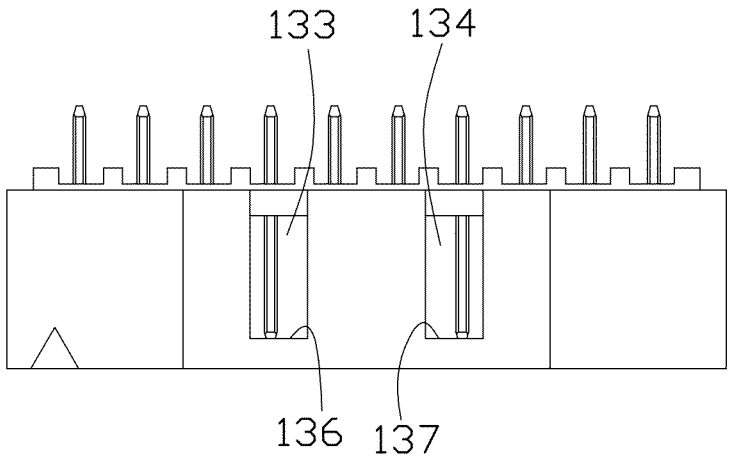
FIG. 5 is a top view of the receptacle connector.

Referring to FIG. 4, the protrusion 13 is located at the middle of the top wall 121 and is narrower than the top wall 121. The protrusion 13 includes a pair of lateral walls 131 perpendicular to the top wall 121, and a restricting wall 132 connecting top sides of the lateral walls 131 and parallel to the top wall 121. The protrusion 13 defines a receiving chamber 130 in communication with the receiving cavity 10 and the receiving chamber 130 is limited by the lateral walls 131 and the restricting wall 132. Referring to FIG. 2, the restricting wall 132 includes a first slot 133 in communication with the receiving chamber 130, a second slot 134 in communication with the receiving chamber 130, and an intermediate wall 135 separating the first slot 133 and the second slot 134. Each of the first slot 133 and the second slot 134 is rectangular. The restricting wall 132 includes a first locking face 136 exposed in the first slot 133 and a second locking face 137 exposed in the second slot 134. The first locking face 136 and the second locking face 137 are coplanar with each other and are located in a same vertical plane. The first locking face 136 and the second locking face 137 are positioned adjacent to the mating face 11 for locking with the locking member 7 of the plug connector 200. Besides, the first slot 133 and the second slot 134 are parallel to each other and each extend along a front-to-back direction.

According to the illustrated embodiment of the present invention, the first slot 133 and the second slot 134 extend through the restricting wall 132 along a top-to-bottom direction. However, in other embodiments, the first slot 133 and the second slot 134 may not extend through the restricting wall 132 along the top-to-bottom direction. Under this condition, each of the first locking face 136 and the second locking face 137 corresponds to a surface of a step wall. Besides, with the protrusion 13 integral with the receptacle insulative housing 1, positional relationship of the first and the second locking faces 136, 137 is invariable with respect to the mating face 11 as a result that the first and the second locking faces 136, 137 are capable of providing stable locking effect and there is no need to consider connection loose of the protrusion 13 if it is separately assembled to the receptacle insulative housing 1.

Besides, the receptacle insulative housing 1 includes a mounting wall 124 inside the receiving cavity 10, and the receptacle contacts 2 are arranged in two rows and fixed to the mounting wall 124. According to the illustrated embodiment of the present invention, the receptacle contacts 2 are arranged in matrix and are fixed to the mounting wall 124 through insert-molding technology so as to not only reduce assembling costs, but also avoid loose of the receptacle contacts 2. Each receptacle contact 2 is longitudinal along the front-to-back direction and includes a cantilevered contacting portion 21 extending into the receiving cavity 10 for engaging with the plug contacts 4 of the plug connector 200 and a soldering portion 22 extending beyond the mounting wall 124 for mounting to a PCB (not shown).

Figure 6:
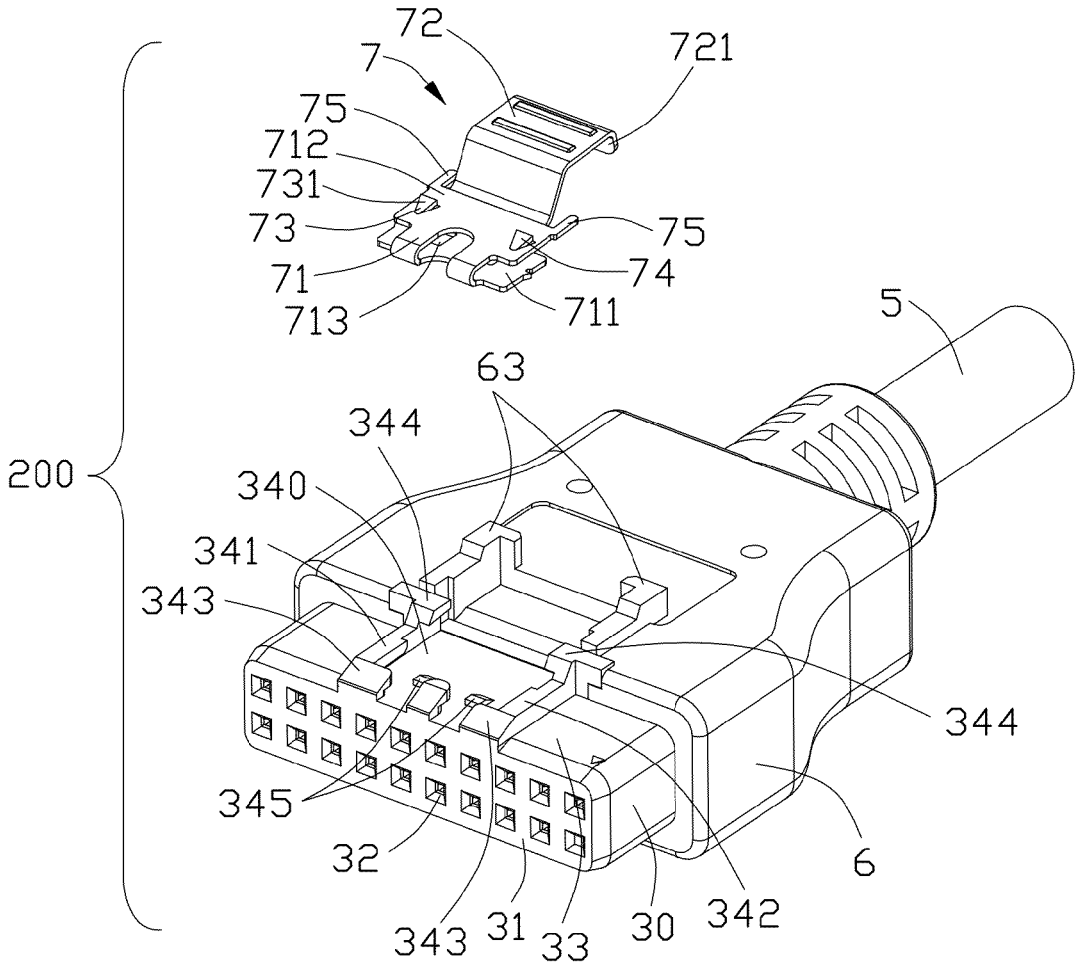
FIG. 6 is a partly exploded view of the plug connector with a locking member separated therefrom.
Figure 7:
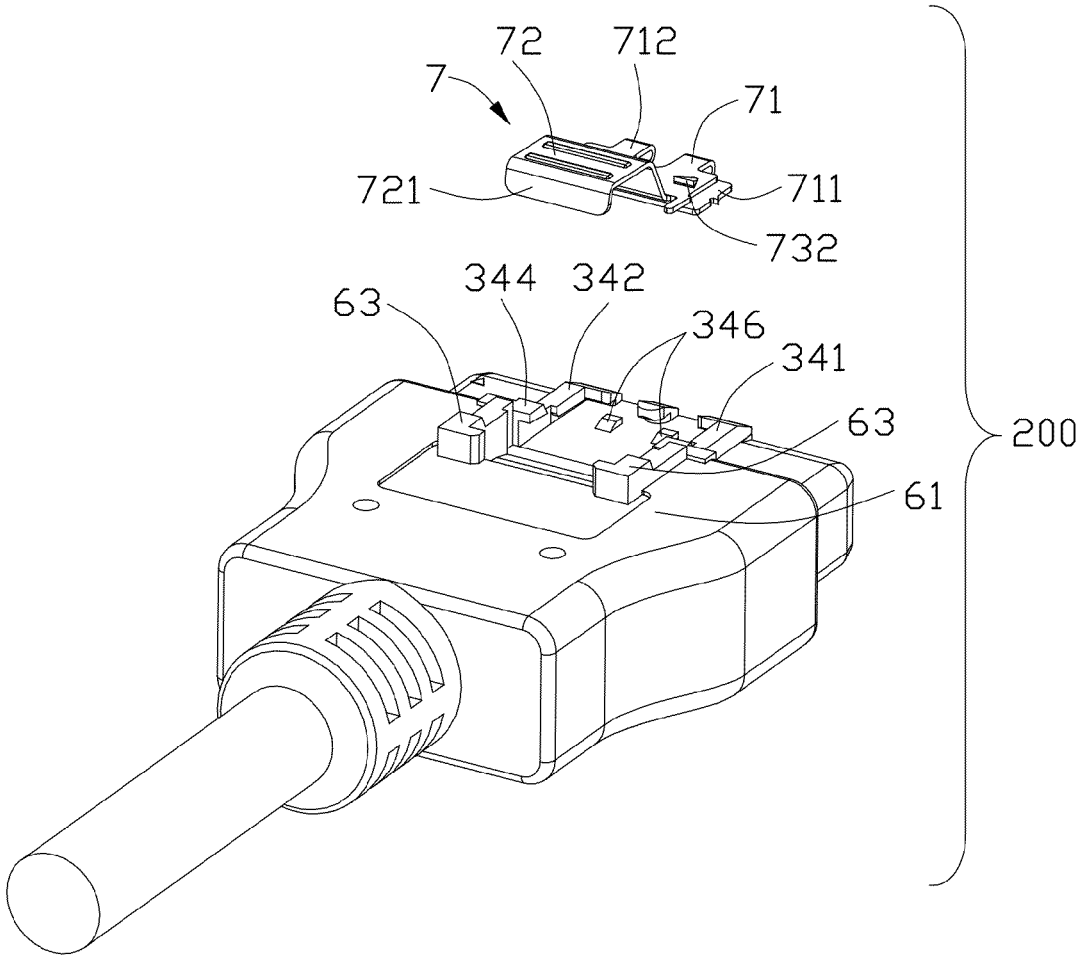
FIG. 7 is another partly exploded view of the plug connector as shown in FIG. 6.
Figure 8:
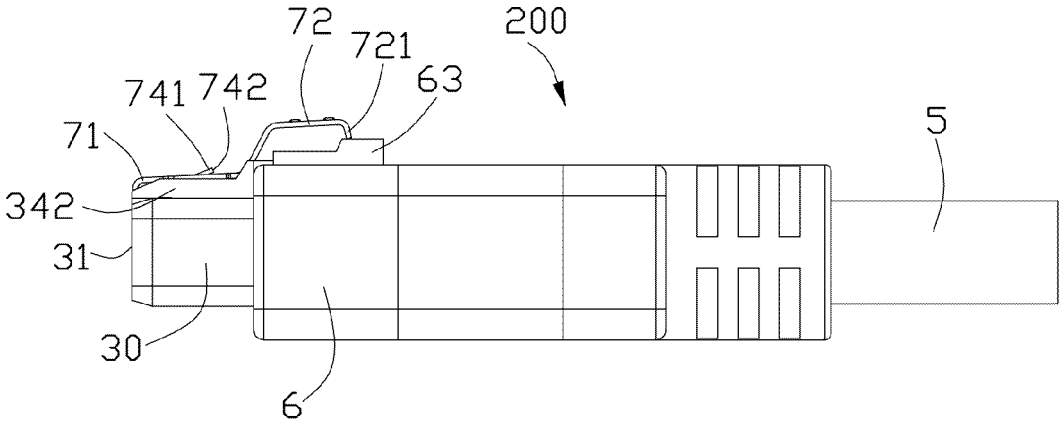
FIG. 8 is side view of the plug connector.

Referring to FIGS. 6 to 10, the plug insulative housing 3 includes a rectangular mating portion 30 extending forwardly beyond the over-molding portion 6. The mating portion 30 includes an inserting face 31, a plurality of contact-receiving slots 32 extending through the inserting face 31, a top wall 33 and a plurality of position blocks 34 protruding beyond the top wall 33 (as shown in FIG. 2). The position blocks 34 include a first block 341, a second block 342 opposite to the first block 341 and a clip space 340 formed by and between the first block 341 and the second block 342. Each of the first block 341 and the second block 342 includes a first slant surface 343 adjacent to the inserting face 31 for guiding insertion of the plug connector 200 into the receptacle connector 100, and a raised portion 344 adjacent to the over-molding portion 6 for pressing against the locking member 7. The mating portion 30 further includes a pair of position projections 345 protruding into the clip space 340. Each position projection 345 includes a second slant surface 346 (as shown in FIG. 7). The first slant surface 343 and the second slant surface 346 extend along opposite slant directions. That is to say, one of the slopes of the first slant surface 343 and the second slant surface 346 is positive and the other of the slopes is negative.

Referring to FIG. 7, according to the illustrated embodiment of the present invention, the over-molding portion 6 peripherally encloses the plug insulative housing 3 through over-molding technology so as to improve the whole intensity of the plug connector 200. The over-molding portion 6 includes a top wall 61 and a pair of protection blocks 63 protruding upwardly beyond the top wall 61. The locking member 7 is positioned between so as to be protected by the pair of protection blocks 63.

Referring to FIGS. 6 and 7, the locking member 7 is made of metal through stamping and bending processes. The locking member 7 is resilient and includes a front section 71 secured to the mating portion 30 and a suspended pressing section 72 extending backwardly and upwardly from the front section 71. The front section 71 includes a bottom plate 711 and a top plate 712 folded above the bottom plate 711. In assembling, the front section 71 is positioned in the clip space 340 with the bottom plate 711 inserted under the first block 341 and the second block 342 from a back-to-front direction and the front section 71 pressed by the position blocks 34 along a vertical direction. Besides, the bottom plate 711 defines a pair of openings 713 for locking with the pair of position projections 345. The second slant surfaces 346 are adapted for guiding assembly of the locking member 7 via guiding the position projections 345 sliding into the openings 713. Once the position projections 345 are received in the openings 713, the locking member 7 can be prevented from escaping the plug insulative housing 3 backwardly. The top plate 712 is stamped upwardly to form a pair of first locking protrusion 73 and a second locking protrusion 74 symmetrical to first locking protrusion 73 from left to right. The first and the second locking protrusions 73, 74 respectively include inclined first and second guiding surfaces 731, 741, and first and second locking surfaces 732, 742 behind the first and second guiding surfaces 731, 741. The first and the second locking protrusions 73, 74 are downwardly movable together with the top plate 712 under the drive of the pressing section 72.

Figure 9:
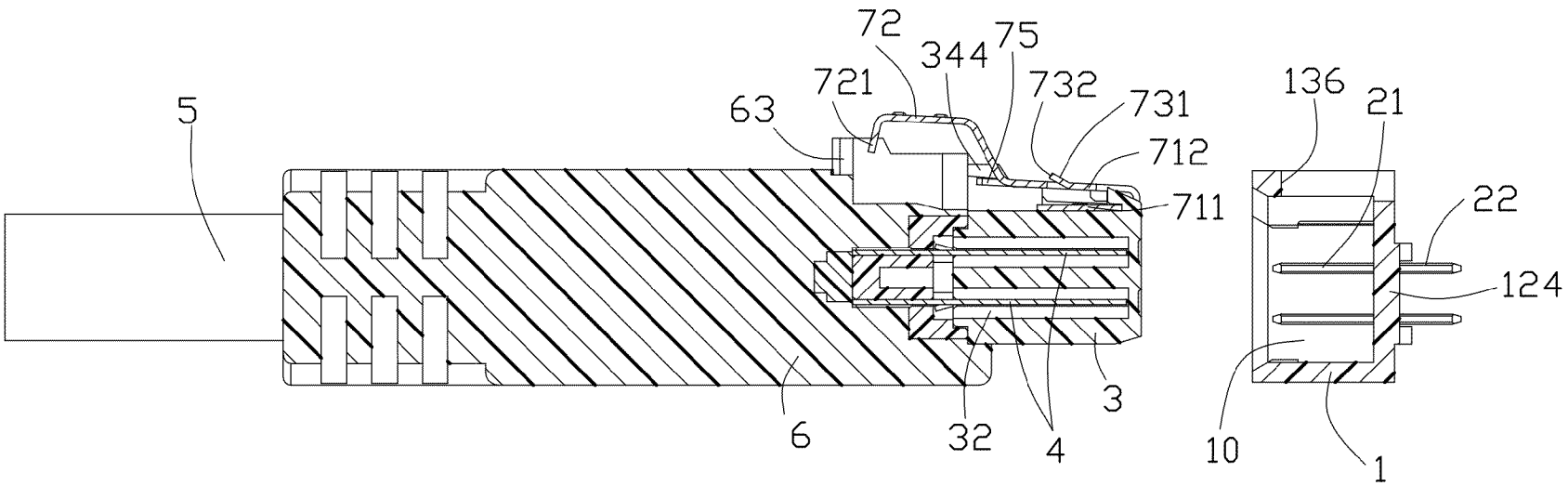
FIG. 9 is a cross-sectional view of the connector assembly taken along line A-A of FIG. 2.
Figure 10:
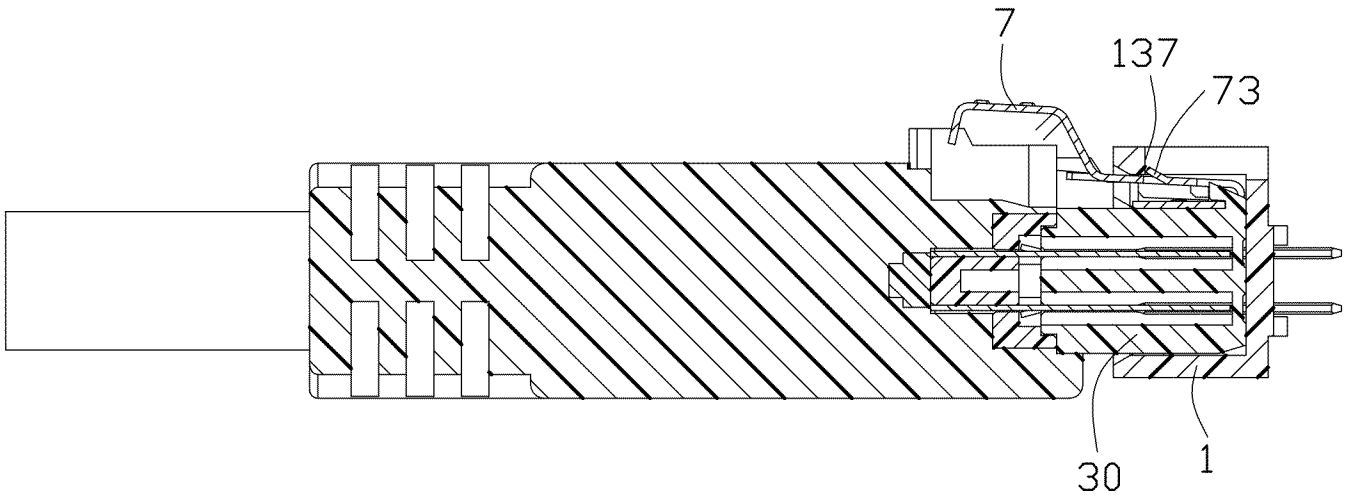
FIG. 10 is a cross-sectional view of the connector assembly taken along line B-B of FIG. 1.

Besides, the top plate 712 of the locking member 7 includes a pair of wings 75 extending backwardly and located at opposite sides of the pressing section 72. As shown in FIG. 9, the wings 75 are positioned below the raised portions 344 and are pressed against by the raised portions 344 to prevent the locking member 7 from over-deforming and disengaging from the plug insulative housing 3. The pressing section 72 includes a distal end 721 which is positioned between and is arranged lower than the pair of protection blocks 63. Under this arrangement, on one hand, the pressing section 72 can be well protected by the protection blocks 63, and on the other hand, scraping-hand feeling can be avoided when the finger touches the distal end 721.

Referring to FIGS. 1, 2, 9 and 10, when the plug connector 200 is inserted into the receiving cavity 10 of the receptacle connector 100, the first slant surfaces 343 of the mating portion 30 is capable of guiding insertion of the plug connector 200. Besides, under the guide of the inclined first and second guiding surfaces 731, 741, the first and the second locking protrusions 73, 74 easily slides into the first and the second slots 133, 134. As a result, the front section 71 of the locking member 7 is received in the receiving chamber 130 with the first and the second locking surfaces 732, 742 abutting against the first and the second locking faces 136, 137. That is to say, when the plug connector 200 is fully inserted in the receptacle connector 100, they can lock with each other stably via the locking member 7 locking with the first and the second locking faces 136, 137.

When it is needed to pull out the plug connector 200 from the receptacle connector 100, an external force, e.g. generated by the finger, is applied to downwardly press the suspended pressing section 72. Under this condition, the first and the second locking protrusions 73, 74 are driven downwardly by the pressing section 72 to unlock with the first and the second locking faces 136, 137. As a result, the plug connector 200 can be pulled out from the receptacle connector 100.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. A receptacle connector comprising:

a receptacle insulative housing comprising a mating face, a receiving cavity extending through the mating face for accommodating a mateable plug connector, and a plurality of peripheral walls enclosing the receiving cavity; and a plurality of receptacle contacts fixed to the receptacle insulative housing, each receptacle contact comprising a cantilevered contacting portion extending into the receiving cavity; wherein the receptacle insulative housing integrally forms a protrusion which extends beyond one of the peripheral walls, the protrusion defining a receiving chamber in communication with the receiving cavity and a restricting wall for limiting the receiving chamber, the restricting wall comprising a first slot extending along a front-to-back direction and a first locking face exposed in the first slot for locking with the plug connector, the first slot extending through the restricting wall along a top-to-bottom direction and in communication with the receiving chamber, the first locking face located in a vertical plane and adjacent to the mating face;

wherein the restricting wall defines a second slot separated from and parallel to the first slot, the second slot extending through the restricting wall along the top-to-bottom direction and in communication with the receiving chamber so as to form a second locking face exposed in the second slot, the second locking face being adapted for locking with the plug connector as well.

2. The receptacle connector as claimed in claim 1, wherein the protrusion is reversed U-shaped.

3. The receptacle connector as claimed in claim 1, wherein the second locking face is coplanar with the first locking face, and the second locking face is located in the vertical plane adjacent to the mating face.

4. The receptacle connector as claimed in claim 1, wherein the peripheral walls comprise a top wall, a bottom wall and a pair of side walls connecting the top wall and the bottom wall, the top wall and the bottom wall each comprising at least one emboss exposed to the receiving cavity for improving engaging friction when the plug connector is inserted in the receiving cavity of the receptacle connector.

5. A plug connector comprising:

an over-molding portion;

a plug insulative housing enclosed by the over-molding portion, the plug insulative housing comprising a mating portion protruding forwardly beyond the over-molding portion, the mating portion defining an inserting face;

a plurality of plug contacts fixed in the plug insulative housing; and a metallic locking member mounted to the plug insulative housing, the metallic locking member comprising a front section secured to the mating portion and a pressing section extending backwardly and upwardly from the front section, the front section comprising a first locking protrusion which is downwardly movable under the drive of the pressing section, the first locking protrusion comprising an inclined first guiding surface for easy insertion and a first locking surface behind the first guiding surface for locking with a receptacle connector;

wherein the front section of the metallic locking member comprises a bottom plate and a top plate folded above the bottom plate, the first locking protrusion being stamped upwardly from the front section, the metallic locking member further comprising a second locking protrusion symmetrical to first locking protrusion under condition that the second locking protrusion is stamped upwardly from the front section and comprises an inclined second guiding surface for being easily inserted into the receptacle connector and a second locking surface behind the second guiding surface for locking with the receptacle connector;

wherein the mating portion comprises a top wall and a plurality of position blocks protruding beyond the top wall, the position blocks comprising a first block, a second block and a clip space between the first block and the second block, each of the first block and the second block comprising a first slant surface adjacent to the inserting face under condition that the front section of the metallic locking member is positioned in the clip space and is pressed by the position blocks along a vertical direction.

6. The plug connector as claimed in claim 5, wherein the mating portion comprises a pair of position projections protruding into the clip space, and the bottom plate defines a pair of openings in which the position projections are received, each of the position projections comprising a second slant surface which extends along a slant direction opposite to that of first slant surface, the second slant surfaces being adapted for guiding assembly of the metallic locking member.

7. The plug connector as claimed in claim 6, wherein the top plate of the metallic locking member comprises a pair of wings extending backwardly and located at opposite sides of the pressing section, and the position blocks comprise a pair of raised portions adjacent to the over-molding portion to press against the wings.

8. A connector assembly comprising:

a receptacle connector and a plug connector mateable with the receptacle connector, the receptacle connector comprising:

a receptacle insulative housing comprising a mating face, a receiving cavity extending through the mating face for accommodating the plug connector, and a plurality of peripheral walls enclosing the receiving cavity; and a plurality of receptacle contacts fixed to the receptacle insulative housing, each receptacle contact comprising a contacting portion extending into the receiving cavity;

the plug connector comprising:

a plug insulative housing comprising a mating portion for being received in the receiving cavity, the mating portion defining an inserting face; and a plurality of plug contacts fixed in the plug insulative housing for engaging with the contacting portions of the receptacle contacts; wherein the receptacle insulative housing integrally forms a protrusion which extends beyond one of the peripheral walls, the protrusion defining a receiving chamber in communication with the receiving cavity and a restricting wall for limiting the receiving chamber, the restricting wall comprising a first locking face; and wherein the plug connector comprises a resilient locking member mounted to the plug insulative housing, the locking member comprising a front section secured to the mating portion and a pressing section extending backwardly and upwardly from the front section, the front section comprising a first locking protrusion which comprises an inclined first guiding surface and a first locking surface behind the first guiding surface, when the plug connector is inserted in the receiving cavity of the receptacle connector, the first locking protrusion is downwardly movable under the drive of the pressing section so as to make the first locking surface lock with the first locking face;

wherein the restricting wall defines a first slot extending through the restricting wall and in communication with the receiving chamber, the first locking face being exposed in the first slot; and wherein the front section of the locking member comprises a bottom plate and a top plate folded above the bottom plate, the first locking protrusion being stamped upwardly from the front section, the first guiding surface being adapted for guiding the first locking protrusion sliding into the first slot.

9. The connector assembly as claimed in claim 8, wherein the restricting wall defines a second slot separated from and parallel to the first slot, the second slot extending through the restricting wall and in communication with the receiving chamber so as to form a second locking face exposed to the second slot; and wherein the locking member further comprises a second locking protrusion symmetrical to first locking protrusion under condition that the second locking protrusion is stamped upwardly from the front section and comprises an inclined second guiding surface and a second locking surface behind the second guiding surface, the second guiding surface being adapted for guiding the second locking protrusion sliding into the second slot so as to make the second locking surface lock with the second locking face.

10. The connector assembly as claimed in claim 8, wherein the mating portion comprises a top wall and a plurality of position blocks protruding beyond the top wall, the position blocks comprising a first block, a second block and a clip space between the first block and the second block, each of the first block and the second block comprising a first slant surface adjacent to the inserting face under condition that the front section of the locking member is positioned in the clip space and is fixed by the position blocks along a vertical direction.

11. The connector assembly as claimed in claim 8, wherein the peripheral walls comprise a top wall, a bottom wall and a pair of side walls connecting the top wall and the bottom wall, the top wall and the bottom wall each comprising at least one emboss exposed to the receiving cavity for improving engaging friction when the plug connector is inserted in the receiving cavity of the receptacle connector.

12. The connector assembly as claimed in claim 11, wherein the protrusion is reversed U-shaped and is integrated with the receptacle insulative housing.

13. The connector assembly as claimed in claim 8, wherein the mating portion comprises a pair of position projections protruding into the clip space, and the bottom plate defines a pair of openings in which the position projections are received, each of the position projections comprising a second slant surface which extends along a slant direction opposite to that of first slant surface, the second slant surfaces being adapted for guiding assembly of the locking member.

14. The connector assembly as claimed in claim 13, wherein the top plate of the metallic locking member comprises a pair of wings extending backwardly and located at opposite sides of the pressing section, and the position blocks comprise a pair of raised portions adjacent to the over-molding portion to press against the wings.

* * * * *